US011719075B2

(12) United States Patent
Vehra et al.

(10) Patent No.: US 11,719,075 B2
(45) Date of Patent: Aug. 8, 2023

(54) TORQUE TO LINEAR DISPLACEMENT FOR DOWNHOLE POWER REGULATION

(71) Applicant: Halliburton Energy Services, Inc., Houston, TX (US)

(72) Inventors: Imran Sharif Vehra, Kingwood, TX (US); Nataraj Chinnappan, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 119 days.

(21) Appl. No.: 17/396,013

(22) Filed: Aug. 6, 2021

(65) Prior Publication Data

US 2023/0044672 A1 Feb. 9, 2023

(51) Int. Cl.

| | |
|---|---|
| ***E21B 41/00*** | (2006.01) |
| ***F03B 3/04*** | (2006.01) |
| ***F03B 3/12*** | (2006.01) |
| ***F03B 17/06*** | (2006.01) |
| *F03B 3/16* | (2006.01) |

(52) U.S. Cl.

CPC ..... *E21B 41/0085* (2013.01); *F03B 3/04* (2013.01); *F03B 3/126* (2013.01); *F03B 17/061* (2013.01); *F03B 3/16* (2013.01); *F05B 2220/7068* (2013.01); *F05B 2280/5003* (2013.01); *F05B 2280/5008* (2013.01)

(58) Field of Classification Search

CPC ..... F03B 3/04; F03B 3/126; F03B 17/061; F05B 2220/7068; F05B 2280/5003; F05B 2280/5008; E21B 41/0085

See application file for complete search history.

(56) References Cited

U.S. PATENT DOCUMENTS

| | | | |
|---|---|---|---|
| 5,675,203 | A | 10/1997 | Schulze et al. |
| 7,133,325 | B2 | 11/2006 | Kotsonis et al. |
| 7,327,634 | B2 | 2/2008 | Perry et al. |
| 8,297,375 | B2 | 10/2012 | Hall et al. |
| 9,476,401 | B2 | 10/2016 | Han |
| 9,490,736 | B2 | 11/2016 | Han |

(Continued)

FOREIGN PATENT DOCUMENTS

| | | |
|---|---|---|
| CA | 1191531 | 8/1985 |
| WO | 2017-223057 | 12/2017 |

OTHER PUBLICATIONS

International Search Report and Written Opinion for Application No. PCT/US2021/046821, dated May 4, 2022.

*Primary Examiner* — Kristyn A Hall

(74) *Attorney, Agent, or Firm* — Benjamin Ford; C. Tumey Law Group PLLC

(57) ABSTRACT

A downhole turbine may include a stator disposed in a turbine housing, a rotor disposed between the stator and the turbine housing and wherein the rotor includes an outer housing, a gap that separates the stator and the rotor, wherein the gap is oil filled, and one or more blades disposed on the outer housing between the turbine housing and the rotor. The downhole turbine may further include a compressible medium attached to the outer housing between the stator and the outer housing, wherein the compressible medium is separated from the stator by the gap, and one or more magnets attached to an inner surface of the compressible medium, wherein the one or more magnets are separated from the stator by the gap.

19 Claims, 5 Drawing Sheets

(56) References Cited

U.S. PATENT DOCUMENTS

| | | | | |
|---|---|---|---|---|
| 9,551,186 | B2 | 1/2017 | Amsellem | |
| 9,657,561 | B1 | 5/2017 | Bargach et al. | |
| 10,050,504 | B2 | 8/2018 | Yim et al. | |
| 2003/0071532 | A1 | 4/2003 | Post | |
| 2017/0362953 | A1* | 12/2017 | Gatzen | E21B 41/0085 |
| 2019/0085668 | A1 | 3/2019 | McMullen et al. | |
| 2019/0368325 | A1 | 12/2019 | McMullen et al. | |
| 2020/0295640 | A1 | 9/2020 | Tegeler et al. | |
| 2020/0362671 | A1 | 11/2020 | Vick, Jr. et al. | |

* cited by examiner

TORQUE TO LINEAR DISPLACEMENT FOR DOWNHOLE POWER REGULATION

BACKGROUND

Drilling of oil and gas wells typically involves the use of several different measurement and telemetry systems to provide data regarding the subsurface formation penetrated by a borehole, and data regarding the state of various drilling mechanics during the drilling process. In measurement-while-drilling (MWD) tools, for example, data is acquired using various sensors located in the drill string near the drill bit. This data is either stored in downhole memory or transmitted to the surface using assorted telemetry means, such as mud pulse or electromagnetic telemetry devices. Such sensors require electrical power and, since it is not feasible to run an electric power supply cable from the surface through the drill string to the sensors, the electrical power is often obtained downhole.

In some cases, for instance, the sensors may be powered using batteries installed in the drill string at or near the location of the sensors. Such batteries, however, have a finite life, that incurs high cost in replacement, disposal and repair and maintenance cost in constantly replacing these batteries in the BHA. On many occasions there is a loss in power downhole causing a trip for failure as the battery remaining life may not have been tracked / metered properly. These batteries, typically lithium thionyl chloride, may vent hazardous gases if vented. In other cases, the sensors may be powered using an electrical power generator included in the drill string. For instance, a typical drilling fluid flow-based power generator employs a rotor shaft having extending radially therefrom. The rotors are placed in the drilling fluid flow path to convert the hydraulic energy of the drilling fluid into rotation of the rotor shaft. As the rotor shaft rotates, electrical power may be generated in an associated coil generator. In other applications, the rotational energy of the rotor shaft may be transmitted to various downhole devices, if desired.

When an electrical fault occurs within the generator, such as intermittent shorts on the AC or DC stage of the power rail, such systems quickly fail. This is because the input energy due to the flow of the mud is not regulated. The continuous flow of mud causes the downhole generator to continue to generate power. The created power, in the form of electricity, may flow sporadically and freely through the electrical fault or "short" that has originated in the generator. Continually allowing the free movement of electricity through the short may lead to mechanical and electrical failure. This may lead to larger issues in which the power generation system completely fails, effectively preventing further drilling operations.

BRIEF DESCRIPTION OF THE DRAWINGS

The following figures are included to illustrate certain aspects of the present disclosure and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is generally related to downhole drilling assemblies and, more particularly, to downhole turbine assemblies for power generation and/or device actuation. Systems and methods described below may allow for the continuous delivery or power to a bottom hole assembly (BHA) from a downhole generator even if the generator is experiencing an electrical fault or mechanical fault. Continuous delivery of power at a reduced rate, which may allow for continued downhole operations, may be defined as operations under a "limp" mode. The intent of such fault tolerant systems is to deliver enough power even under a fault state in order to complete a downhole operation.

During downhole operation, if a fault occurs, such as an electrical fault, in the downhole generator the turbine section of the generator may perform mechanical functions to protect itself, the generator, and BHA. In examples, turbine section may mechanically protect itself utilizing a torsional system. For example, the rotor may include a torsional system that places one or more magnets under tension. During operations, the stator and rotor work together to produce electricity. However, a short in the stator may cause the electricity to overpower, and eventually destroy, circuitry attached to the stator as well as winding in the stator. This may lead to a complete failure of the downhole turbine to effectively produce electricity and distribute the electricity to other systems in a BHA. For example, in a short, the magnetic field in the stator is amplified. The amplified magnetic field, which is felt by the magnets, applies additional magnetic force to each magnet, pushing in a radial direction.. The amplified magnetic force overcomes the tensions and moves the magnets of the rotor radially away from the stator. Moving the magnets away from the stator, as discussed below in a radial direction, reduces the amount of electricity produces and prevent an overload of circuitry in the stator, effectively preventing the total failure of the downhole turbine. The torsional system in the downhole turbine may allow for electricity to be produced in a reduced manner that may allow for the BHA to complete downhole operations.

Figure 1:
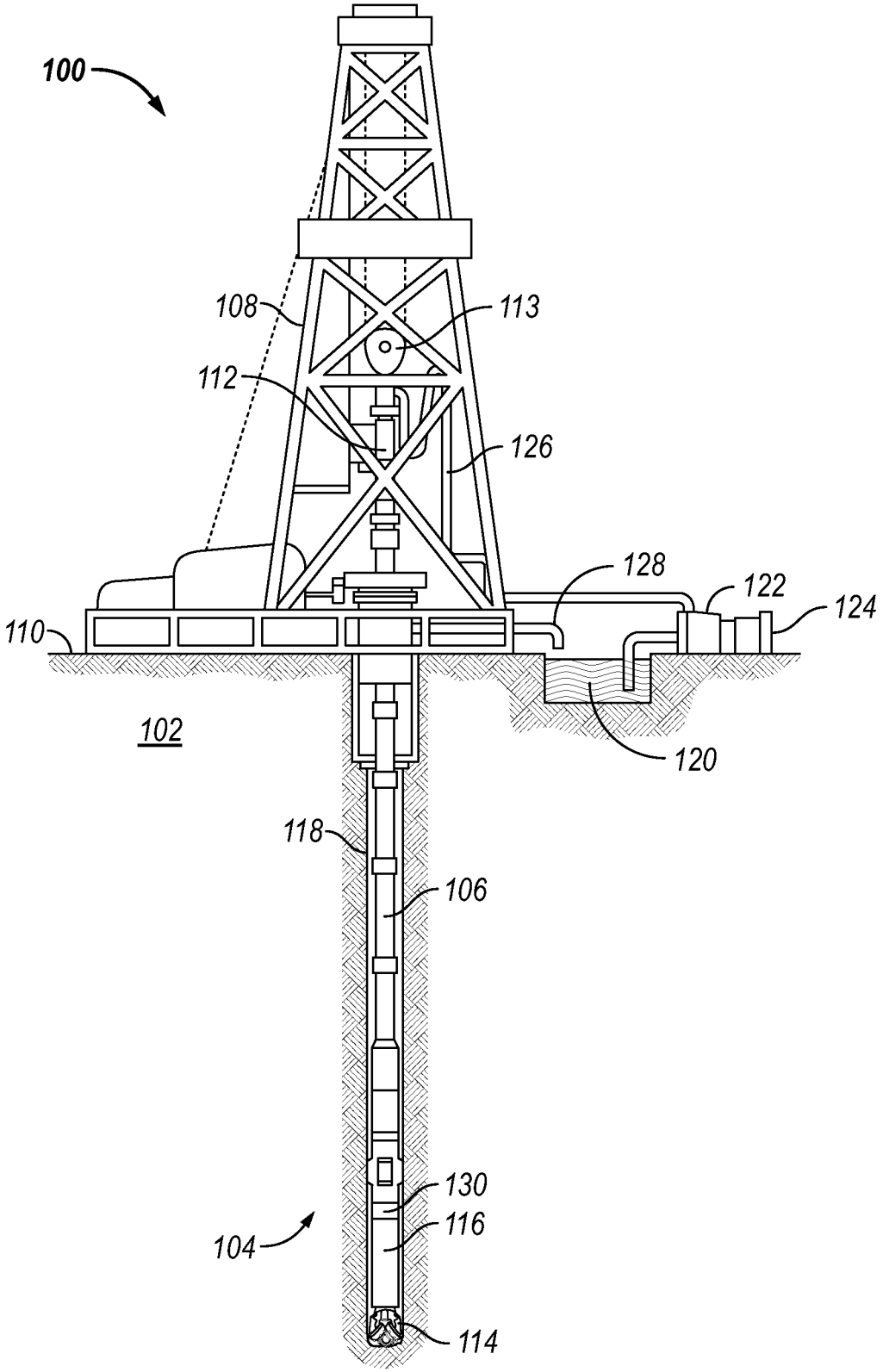
FIG. 1 is a schematic diagram of a drilling system that may employ the principles of the present disclosure.

Referring to FIG. 1, illustrated is an exemplary drilling system 100 that may employ one or more principles of the present disclosure. Boreholes may be created by drilling into the earth 102 using the drilling system 100. The drilling system 100 may be configured to drive a bottom hole assembly (BHA) 104 positioned or otherwise arranged at the bottom of a drill string 106 extended into the earth 102 from a derrick 108 arranged at the surface 110. The derrick 108 includes a kelly 112 and a traveling block 113 used to lower and raise the kelly 112 and the drill string 106.

The BHA 104 may include a drill bit 114 operatively coupled to a tool string 116 which may be moved axially within a drilled wellbore 118 as attached to the drill string 106. During operation, the drill bit 114 penetrates the earth 102 and thereby creates the wellbore 118. The BHA 104 provides directional control of the drill bit 114 as it advances into the earth 102. The tool string 116 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 116, as shown in FIG. 1.

Fluid or "mud" from a mud tank 120 may be pumped downhole using a mud pump 122 powered by an adjacent power source, such as a prime mover or motor 124. The mud may be pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting the drill bit 114, the mud circulates back to the surface 110 via the annulus defined between the wellbore 118 and the drill string 106, and in the process returns drill cuttings and debris to the surface. The cuttings and mud mixture are passed through a flow line 128 and are processed such that a cleaned mud can be returned down hole through the stand pipe 126 once again.

As illustrated, the drilling system 100 may further include a downhole turbine 130 arranged in the drill string 106 and, more particularly, in the tool string 116. The downhole turbine 130 may have a rotor shaft with one or more blades extending radially therefrom. The one or more blades (discussed in detail below) may be placed in a path of the drilling fluid as it circulates through the drill string 106, and thereby converting hydraulic energy of the drilling fluid into rotation of the rotor shaft. In some embodiments, rotating the rotor shaft may provide rotational energy used to actuate or otherwise rotate an adjacent downhole device or mechanism. For example, rotating the rotor shaft may generate electrical power in an associated coil generator, and the electrical power may be used to power adjacent electrical-consuming devices, such as sensors associated with the MWD and/or LWD tools, or a rotary steerable drilling tool.

Although the drilling system 100 is shown and described with respect to a rotary drill system in FIG. 1, those skilled in the art will readily appreciate that many types of drilling systems may be employed in carrying out embodiments of the disclosure. For instance, drills and drill rigs used in embodiments of the disclosure may be used onshore (as depicted in FIG. 1) or offshore (not shown). Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Figure 2A:
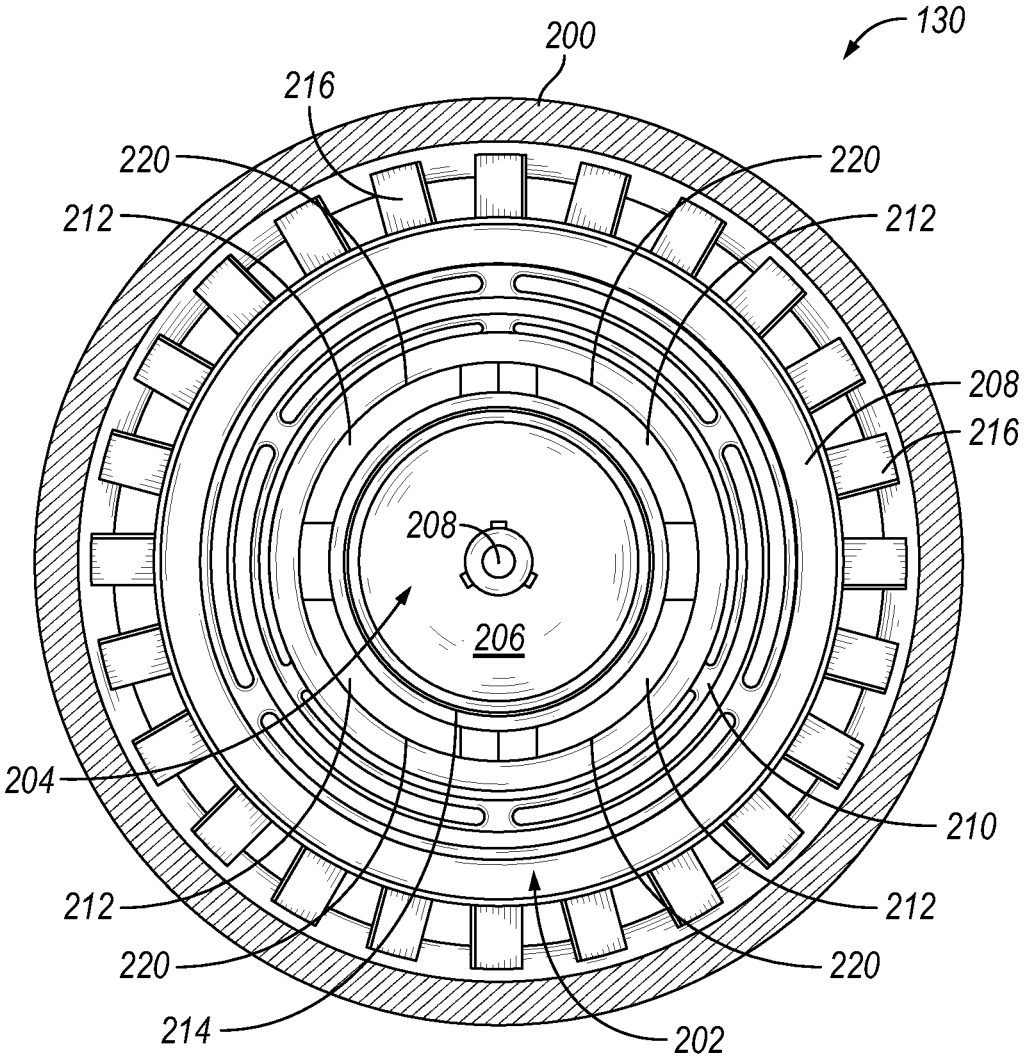
FIGS. 2A and 2B are cross-sectional side views of the downhole turbine assembly.
Figure 2B:
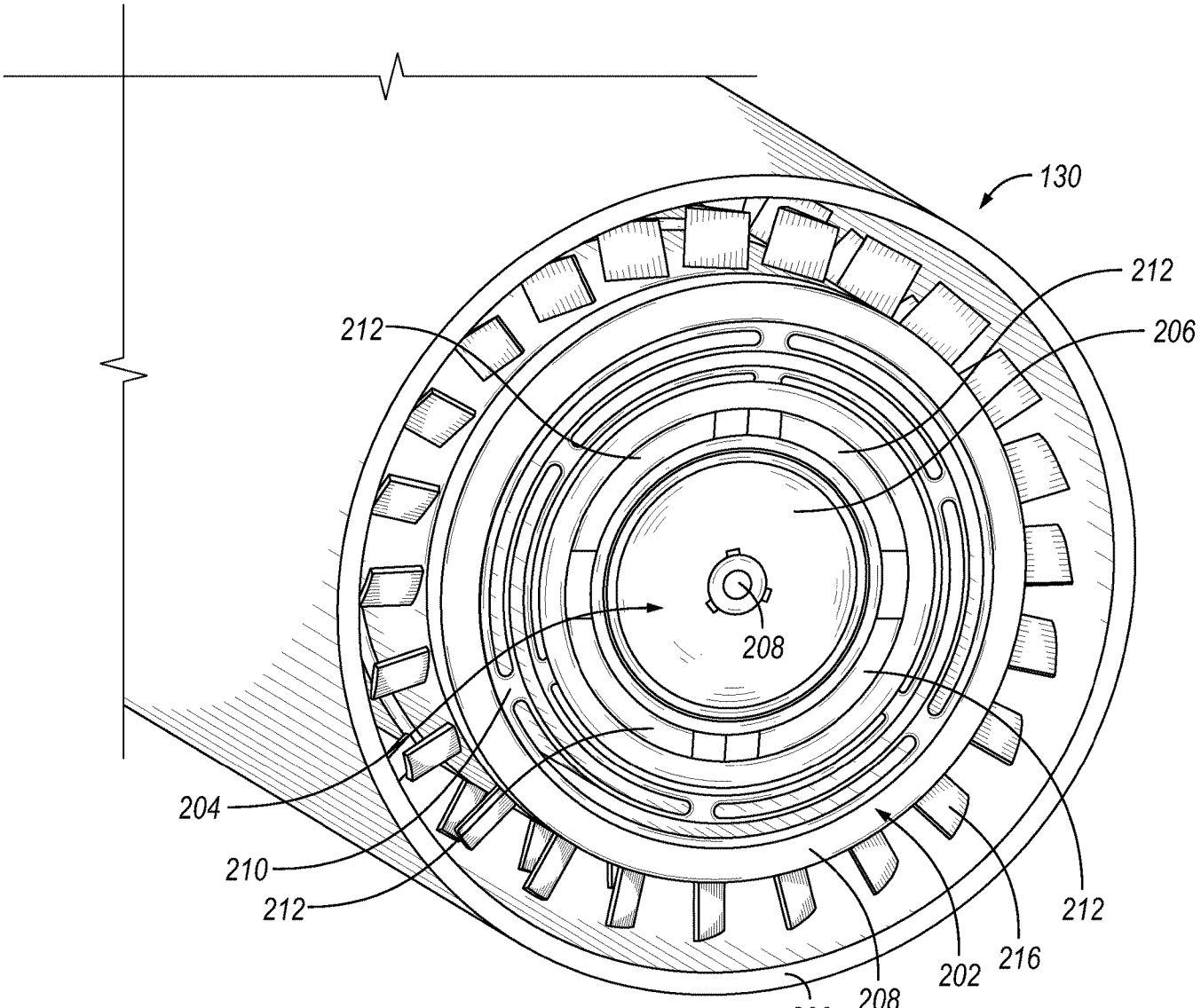

FIGS. 2A and 2B depict a cross sectional view of downhole turbine 130. As discussed above, downhole turbine 130 may be disposed in line with mud flow through tool string 116 (e.g., referring to FIG. 1). As mud pass through downhole turbine 130, electricity is produced by electromagnetic induction. To produce electricity through electromagnetic induction, a rotor 202 and a stator 204 that are disposed in a turbine housing 200 are used.

Stator 204 includes a plurality of armature coils 206 that may be disposed around a magnetic core 208, such as iron. Armature coils 206 are bound to magnetic core 208, which may also act as an internal support. Magnetic core 208 may run longitudinally along the entirety of downhole turbine 130 and is always stagnant in displacement and rotation in the frame of downhole tool 130. The ends of magnetic core 208 are connected to support structures within downhole turbine 130. Armature coils 206 may be wound loops of any type of conductor such as copper. In examples, armature coils 206 are connected to a load (not pictured) providing output power from downhole turbine 130. Armature coils 206 act as a conduit in which generated electricity moves from downhole turbine 130 to BHA 104 (e.g., referring to FIG. 1). The electricity is generated in armature coils 206 by rotor 202.

Rotor 202 rotates around stator 204, which generates electricity inside stator 204. As illustrated, rotor 202 includes an outer housing F, compressible medium 210 and one or more magnets 212. In examples, compressible medium 210 may structurally be a metal, an elastomer, a spring, and/or the like. Rotor 202 may be placed around stator 204 and leave an gap 214 between stator 204 and rotor 202. It should be noted that gap 214 may be filled with any type of suitable oil. Oil may provide pressure balancing, lubrications, and/or heat transfer. Additionally, the inside of downhole turbine 130 may be immersed in oil, including compressible medium 210. Gap 214 allows rotor 202 to rotate around stator 204 without damaging stator 204. To rotate, rotor 202 may rest on ball bearing and/or the like, which connects rotor 202 to downhole turbine 130. To rotate, rotor 202 includes outer housing 220, in which one or more blades 216 are connected to.

Blades 216 are utilized to create movement from the flow of mud down tool string 116 (e.g., referring to FIG. 1) with hydroelectric energy. Blades 216 are employed to add a resistance to mud flow as the mud travels from the surface down tool string 116. Blades 216 may be equally and radially disposed around the exterior of outer housing 220. Each blade 216 may be shaped to allow mud to flow along a narrow end of blade 216. As the mud runs along each blade 216, they curve and widen, directing the mud flow out one end of the blade and down tool string 116. As the mud flow is directed along the curve it imparts a force on each blade 216. The summation of forces imparted on each blade 216 from the mud flow may force blade 216 to move and force rotation of outer housing 220. Thus, transforming hydraulic energy from the mud flow into rotational energy along rotor 202.

As outer housing 220 rotates from the flow of mud, one or more magnets 218 rotate with outer housing 220. Each of the one or more magnets 218 are connected to outer housing 220 by compressible medium 210. Rotor 202 extracts hydraulic energy from the circulation of the mud exerting a force on blades 216 and converts the hydraulic energy into mechanical rotational movement of outer housing 220. Outer housing 220 may be operatively coupled, through compressible medium 210, to one or more magnets 218, which receive the rotational motion from outer housing 220.

Magnets 218 may be disposed radially along an inner most surface 220 of compressible medium 210. In examples, magnets 218 may connect to inner most surface 220 by any suitable method and/or system. For example, suitable methods and/or systems may include, but are not limited to, a compressible fitting, one or more nuts and/or bolts, an adhesive, a weld, and/or the like. As illustrated in FIGS. 2A and 2B, outer most surface of compressible medium 210 may connect compressible medium 210 to outer housing 220. Magnets 218 may be disposed in a pattern in which the radial distances between each adjacent magnet 218 is equal. In examples, magnets 218 may be permanent or electric magnets. If magnets 218 are permanent, they produce a constant magnetic field and do not need to be charged. Conversely, in magnets 218 are electric they are composed of iron, steel, or a different ferrous material and wound with wire wherein a current pass through the wire causing the iron, steel, or ferrous material to become magnetic, producing a magnetic field. Rotation of one or more magnets 218 produces a magnetic field. Each of the magnets 218 may have a "north" or "south" magnetic field. As magnets 218 rotate they produce magnetic flux. Magnetic flux is defined as a measurement of total magnetic field that passes through an identified area. As the magnetic flux passes through each armature coil 206, voltage and current are created as a "north" magnetic field of a "south" magnetic field pass through. The voltage and current create electricity that may be used to power down-hole electronics and/or other downhole tools.

Characterization of electricity created by downhole turbine 130 may be found utilizing the equation given below:

$$N = (C_1 \times Q) - \left(C_2 \times \frac{T}{Q}\right) \tag{1}$$

where, N is the revolution per minute ("RPM"), the variables $C_1$, $C_2$ are coupled turbine geometry and fluid parameters, respectively. Additionally, Q is volume flow rate and T is torque load on rotor 202. Additionally, the power input to downhole turbine 130 is given by:

$$dP \times Q \tag{2}$$

where dP is the pressure drop across downhole turbine 130.

When downhole turbine 130 is used to spin rotor 202 around stator 204, which acts as an alternator, in order to generate electrical power, the governing equation for current in the windings may be described by:

$$I = K_t \times T \tag{3}$$

where I is a current in the windings and $K_t$ are winding parameters. From equations (2) and (3) above it may be inferred that as the current increases (due to an increase in the electrical load), the torque increases and as a result the RPM of downhole turbine 130 decreases.

In embodiments magnets 218 produce magnetic fields as rotate around armature coils 206. Rotating or moving magnetic fields from magnets 218 push and pull electrons within the conductor of armature coils 206 inducing current in armature coils 206 and outputting electrical power. The narrower gap 214 the greater effect the moving magnets 218 have on armature coils 206 to induce a current in armature coils 206. Gap 214 is variable and determined by the compressibility of compressible medium 210. The electrical power produced within armature coils 206 may provide support for a load output of downhole turbine 130 for downhole components.

Figure 3:
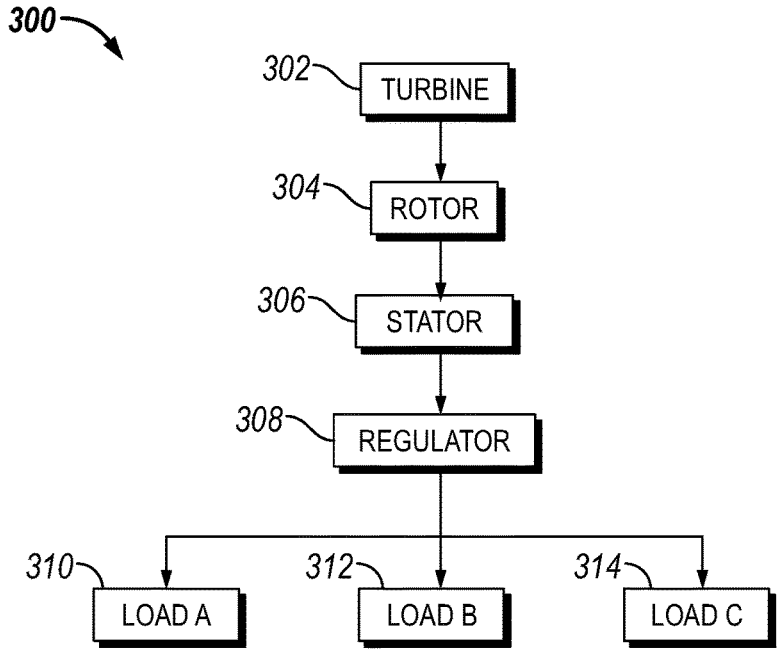
FIG. 3 is a workflow of power generation inside the downhole turbine assembly.

FIG. 3 illustrates a workflow 300 for power creation and distribution downhole. As illustrated, workflow 300 may begin with block 302 in which downhole turbine 130 (e.g., referring to FIG. 2A and 2B) is utilized to create electrical power. For example, as downhole turbine 130 rotates from interaction with mud flow in drill string 106 (e.g., referring to FIG. 1) a rotor in block 304 may rotate around stator 204 (e.g., referring to FIG. 2) in block 306. This may generate electrical power that is an output from stator 204 in block 306. The electrical power is regulated by a power regulator in block 308. The power regulator may transfer electrical power to any number of devices downhole that consume electrical power to operate. These devices are identified in blocks 310 to 314 as Load A, Load B, and/or Load C. It should be noted that there may be any number of device and/or electrical loads. Additionally, any device and/or loads may have electrical power transferred to them by the power regulator at the same time, different times, and/or the like.

During downhole operations, electrical power may be generated by utilizing mud flow moving down drill string 106 (e.g., referring to FIG. 1) form the surface to drill bit 114 (e.g., referring to FIG. 1). Downhole turbine 130 may utilize the mud flow to rotate and generate electric power, which one of ordinary skill in the art would understand. Electrical power generated by downhole turbine 130 may be regulated by a power regulator (not illustrated) in the electronics of downhole turbine 130 to form a steady voltage so that the electrical energy obtained may be safely utilized to power other downhole tools/sensors and such systems. Such power regulators typically comprise of power MOSFETs or switching devices with feedback loop control to regulate voltage, current and/or power.

Figure 4:
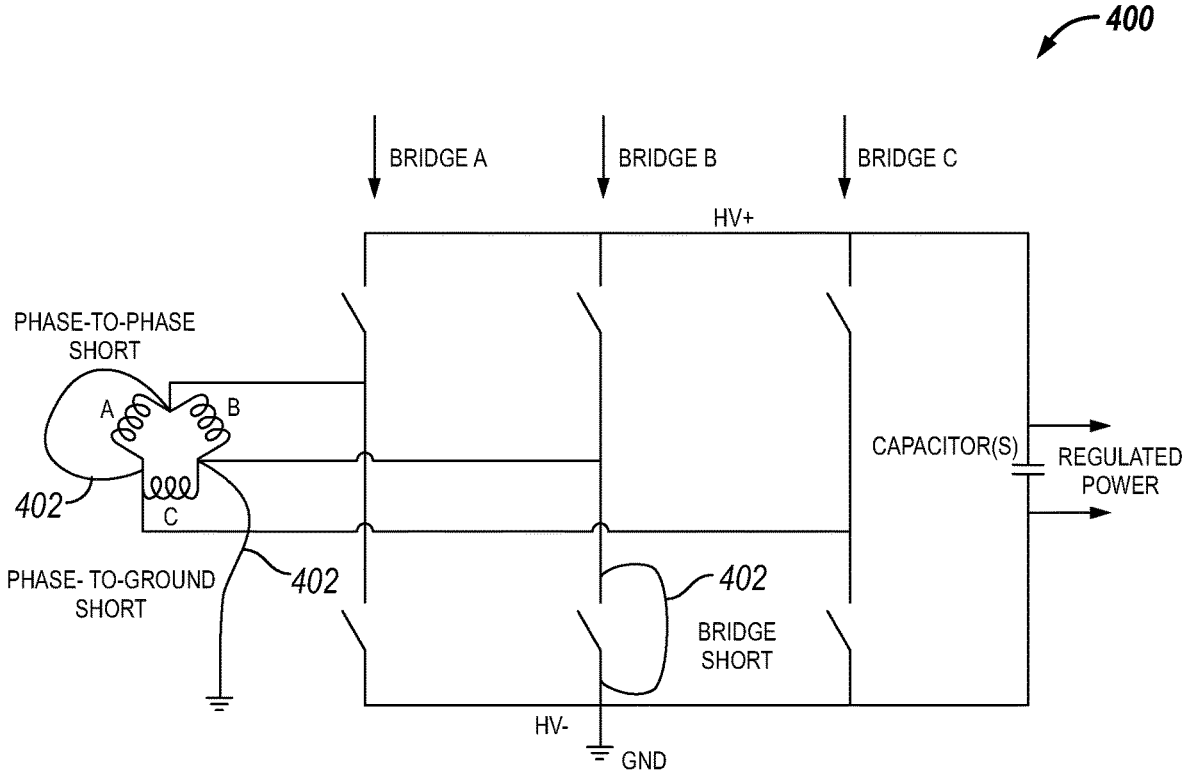
FIG. 4 is an electrical diagram that illustrates one or more shorts.

The generated power is proportional to the mud flow as the revolutions per minute (RPM) of downhole turbine 130 is proportional to the mud flow. The systems and methods disclosed below may allow for a creation of electrical power from a range of mud flow rate. For example, during operations a high mud flow may generate excessive input electrical power. Under normal conditions one or more power regulators may adjusts the duty cycle of switching field-effect transistors (FETs) to maintain a constant output voltage and keeps the maximum output power under safe limits for downhole turbine 130 and all system. Generally, when a fault occurs, it may be a short at the input of the power regulator or output of stator 204 (e.g., referring to FIG. 2). FIG. 4 illustrates example of an electrical schematic 400 of downhole turbine 130 and possible locations of shorts 402 within electrical schematic 400. It should be noted that shorts 402 are only examples as shorts 402 may be located at any spot within downhole turbine 130. Additionally, a short 402 may be a dead short (close to 0 ohms) or a resistive short.

In such instances there may not be alternate mechanism for power regulation. This may result in failure of stator 204 as circulating currents in armature coils 206 (e.g., referring to FIG. 2) exceed the rated capacity. Armature coils 206 and connections to the power regulator may be typically installed in oil filled housings. Oil is typically needed for pressure balancing, lubrication, and cooling. Electrical shorts may be more prevalent in oil filled housings as apposed to air or gas filled housings. In such instances, the input to downhole turbine 130 (mud flow), cannot be practically altered as a means of power regulation, but the efficiency of stator 204 may be reduced, and as a result provide power regulation at the source instead of through electric circuitry, such as the power regulator. Additionally, in certain fault scenarios a fault may occur if the power regulator itself fails, such as shorting of one of the phases. In this case there is no means of pulse width modulation adjustment for power regulation. The power regulation at the source described in the methods and systems above may prevent permanent damage of stator 204.

As the load for downhole components increases, the current induced within the windings increases as well. High currents throughout armature coils 206 yields not only high electric power to satisfy the load, but also excessive heat. When the heat is excessive, conductive material from individual windings deforms and mold together to form a short in one or more armature coils 206. When a short occurs in one or more armature coils 206, the magnetic field produced by the one or more armature coils 206 increases in strength. The increase in strength increases the torque felt by magnets 218 as magnets 218 must expend more energy to move through increased magnetic field created by the short in the one or more armature coils 206, which increases current in the one or more armature coils 206. This may cause more shorts to occur with the increase in current. In other examples, the short may be in a connection downstream of armature coils 206 but part of downhole turbine 130. For example, the short may be located in, but is not limited to, an AC output of the alternator, a power regulator part of the system, and/or the final DC output power.

However, the increase in the magnetic field pushes magnets 218 outward. This outward expansion from the one or more armature coils 206 is allowed because of compressible medium 210, which increases width of gap 316. As magnets 218 move further outward, the torque felt by magnets 218 decreases, which slows the amount of current produced in the one or more armature coils 206. The reduction in current regulates the power generated, whether the increase in current is due to a fault in the power generation system or one of the loads receiving power from the system. The total power limit is thereby determined by the K factor of compressible medium 210 that may be designed below the point at which the wiring and interconnects would heat excessively beyond there specification. The K factor is defined as a constant of compressible medium 210. The constant may be chosen and designed as the rate of force required to move compressible medium 210 a give distance.

Outward movement of magnets 218 is allowed due to compressible medium 210. Tension within compressible medium 210 (which is associated with material and/or device of compressible medium 210) may be designed based at least in part on an equilibrium point, which is power capability and/or power requirement of downhole turbine 130 (e.g., referring to FIG. 1). The equilibrium point may be designed for individual needs of specific downhole turbines 130. The equilibrium point may be maintained by gap 214. As gap 214 widens, magnets 212 are displaced further from armature coils 206 and thus their moving magnetic fields will induce a smaller current deceasing the load capabilities of downhole turbine 130. As noted above, decreasing the load capabilities is necessary to prevent future faults. Excessive faults in armature coils 206 may result in a total loss in the functionality of any load downhole turbine 130 if armature coils 206 form excessive shorts. Additionally, it should be noted that downhole failures, generally, result from one or more intermittent shorts. Intermittent short are defined as a short that only last for a limited duration of time. However, intermittent shorts may still permanent damage to the system because typical systems are not protected at the power generation stage.

Figure 5:
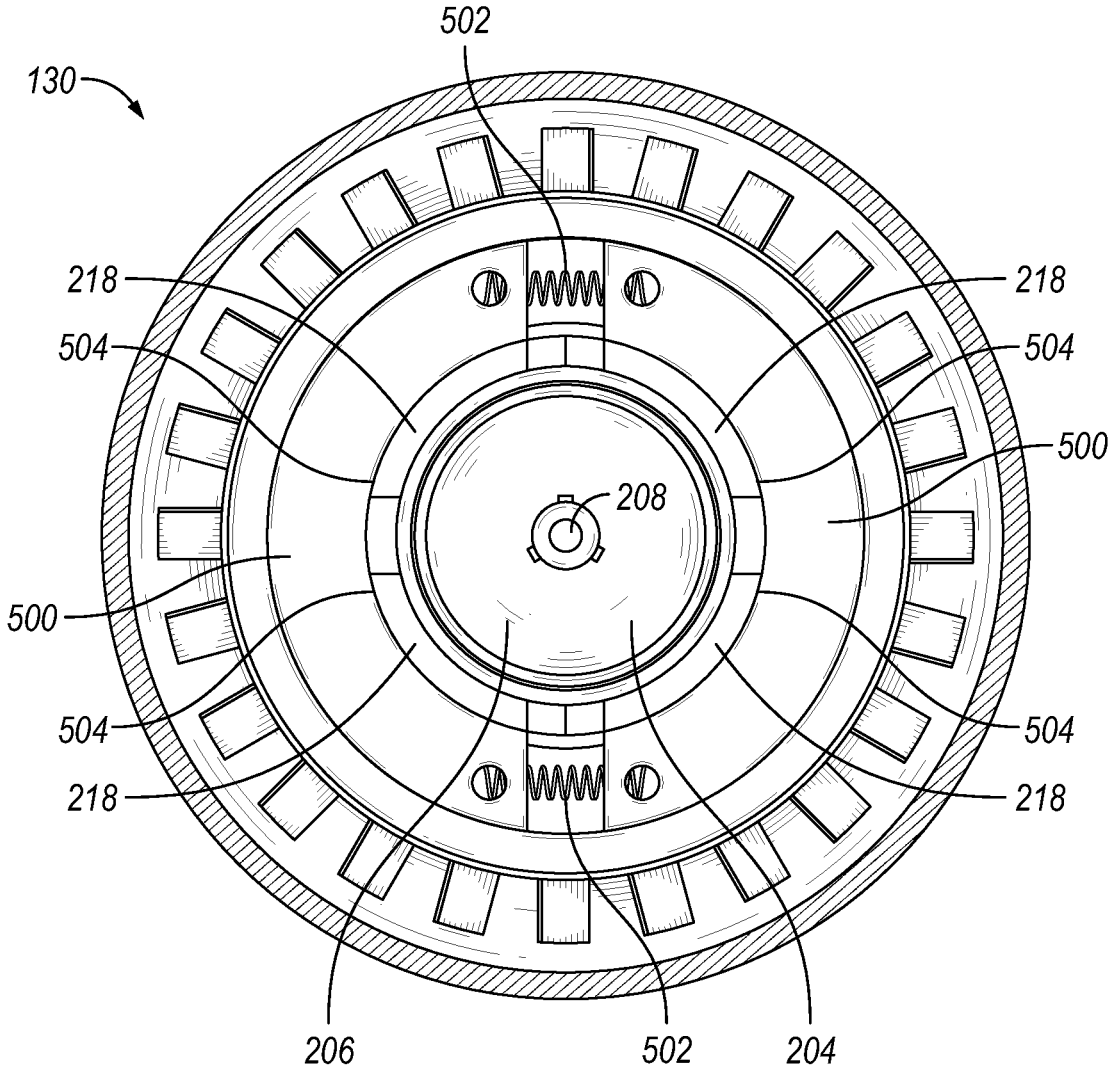
FIG. 5 is a cross-section side view of another embodiment of the downhole turbine.

FIG. 5 illustrates another embodiment in which a plurality of shells 500 may be utilized in place of compressible medium 210 (e.g., referring to FIGS. 2A and 2B). In examples, each shell may be attached to each other may one or more springs 502. Magnets 218 may connect to an inner surface 504 of at least one shell 500 in a similar fashion as discussed above regarding magnets 218 connected to compressible medium 210. Following the same functions and operations discussed above, if a short or other error occurs in one or more armature coils 206, the magnetic field produced by the one or more armature coils 206 increases in strength. The increase in strength increases torque felt by magnets 218, which in turn increases current within the one or more armature coils 206. However, the increase in strength of the magnetic field of the one or more armature coils 206 may cause each shell 500 to move away from stator 204, which in turn moves magnets 218 from armature coils 206. The movement of each shell 500 is allowed due to the properties of spring 502. For example, the force applied to each shell 500 overcomes the elastic tension exerted by springs 502, which may stretch each spring 502. In examples, the elastic tension may cause each spring 502 to collapse and pull each shell 500 toward each other if the force exerted upon each shell 500 is removed. This protects downhole turbine 130 from complete failure, for the reasons discussed above.

The systems and methods described above are an improvement over current technology in that magnetic clutches are not used, and the downhole turbine is not shut down in the case of a fault and/or short. Additionally, the systems and methods described above may continue to send power to downhole tools if a short or fault occurs. This may allow downhole operations to continue to perform operations without removing the tool from the borehole for repair. Furthermore, such a power regulation system at the core generator stage may prevent permanent faults when intermittent shorts occur.

The preceding description provides various embodiments of systems and methods of use which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

Statement 1. A downhole turbine may comprise a stator disposed in a turbine housing, a rotor disposed between the stator and the turbine housing and wherein the rotor includes an outer housing, a gap that separates the stator and the rotor, wherein the gap is oil filled, and one or more blades disposed on the outer housing between the turbine housing and the rotor. The downhole turbine may further include a compressible medium attached to the outer housing between the stator and the outer housing, wherein the compressible medium is separated from the stator by the gap, and one or more magnets attached to an inner surface of the compressible medium, wherein the one or more magnets are separated from the stator by the gap.

Statement 2. The downhole turbine of statement 1, wherein the stator includes a magnetic core.

Statement 3. The downhole turbine of statement 2, wherein one or more armature coils are disposed around the magnetic core.

Statement 4. The downhole turbine of statements 1 or 2, wherein the compressible medium is configured to expand and contract based at least partially on an electromagnetic field effecting the one or more magnets.

Statement 5. The downhole turbine of statement 4, wherein the compressible medium includes one or more grooves.

Statement 6. The downhole turbine of statements 1, 2, or 4, wherein the one or more blades are disposed in one or more adjacent rows down a length of the outer housing.

Statement 7. The downhole turbine of statement 6, wherein the one or more blades are designed to rotate the rotor when a mud is flowing between the outer housing and the turbine housing.

Statement 8. The downhole turbine of statements 1, 2, 4, or 6, wherein the one or more magnets are press fit into the compressible medium.

Statement 9. The downhole turbine of statements 1, 2, 4, 6, or 8, wherein the compressible medium is a metal.

Statement 10. The downhole turbine of statements 1, 2, 4, 6, 8, or 9, wherein the compressible medium is an elastomer.

Statement 11. A downhole turbine may comprise a stator disposed in a turbine housing, a rotor disposed between the stator and the turbine housing and wherein the rotor includes an outer housing, an gap that separates the stator and the rotor, and one or more blades disposed on the outer housing between the turbine housing and the rotor. The downhole turbine may further include one or more shells attached to the outer housing between the stator and the outer housing and wherein the one or more shells are attached to each other by one or more springs, and one or more magnets attached to an inner surface of the one or more shells.

Statement 12. The downhole turbine of statement 11, wherein the stator includes a magnetic core.

Statement 13. The downhole turbine of statement 12, wherein one or more armature coils are disposed around the magnetic core.

Statement 14. The downhole turbine of statements 11 or 12, wherein the one or more shells are configured to expand and contract based at least partially on an electromagnetic field effecting the one or more magnets.

Statement 15. The downhole turbine of statement 14, wherein the one or more springs are configured to attach to each of the one or more shells together.

Statement 16. The downhole turbine of statements 11, 12, or 14, wherein the one or more blades are disposed in one or more adjacent rows down a length of the outer housing.

Statement 17. The downhole turbine of statement 16, wherein the one or more blades are designed to rotate the rotor when a mud is flowing between the outer housing and the turbine housing.

Statement 18. A method may comprise disposing a turbine into a wellbore. The turbine may comprise a stator disposed in a turbine housing, a rotor disposed between the stator and the turbine housing and wherein the rotor includes an outer housing, an gap that separates the stator and the rotor, one or more blades disposed on the outer housing between the turbine housing and the rotor, a compressible medium attached to the outer housing between the stator and the outer housing, wherein the compressible medium is separated from the stator by the gap, and one or more magnets attached to an inner surface of the compressible medium, wherein the one or more magnets are separated from the stator by the gap. The method may further comprise compressing the compressible medium with the one or more magnets when an electromagnetic field from the stator increases in strength from a short in one or more armature coils disposed on the stator.

Statement 19. The method of statement 18, wherein the stator includes a magnetic core.

Statement 20. Th method of statement 19, further comprising reducing a current in the one or more armature coils as the one or more magnets move away from the stator.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

Therefore, the present embodiments are well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A downhole turbine comprising:

a stator disposed in a turbine housing;

a rotor disposed between the stator and the turbine housing, wherein the rotor includes an outer housing;

a gap that separates the stator and the rotor, wherein the gap is oil filled;

one or more blades disposed on the outer housing between the turbine housing and the rotor;

a compressible medium attached to the outer housing between the stator and the outer housing, wherein the compressible medium is separated from the stator by the gap, and wherein the compressible medium is configured to expand and contract based at least partially on an electromagnetic field affecting the one or more magnets; and one or more magnets attached to an inner surface of the compressible medium, wherein the one or more magnets are separated from the stator by the gap.

2. The downhole turbine of claim 1, wherein the stator includes a magnetic core.

3. The downhole turbine of claim 2, wherein one or more armature coils are disposed around the magnetic core.

4. The downhole turbine of claim 1, wherein the compressible medium includes one or more grooves.

5. The downhole turbine of claim 1, wherein the one or more blades are disposed in one or more adjacent rows down a length of the outer housing.

6. The downhole turbine of claim 5, wherein the one or more blades are designed to rotate the rotor when a mud is flowing between the outer housing and the turbine housing.

7. The downhole turbine of claim 1, wherein the one or more magnets are press fit into the compressible medium.

8. The downhole turbine of claim 1, wherein the compressible medium is a metal.

9. The downhole turbine of claim 1, wherein the compressible medium is an elastomer.

10. A downhole turbine comprising:

a stator disposed in a turbine housing;

a rotor disposed between the stator and the turbine housing, wherein the rotor includes an outer housing;

a gap that separates the stator and the rotor;

one or more blades disposed on the outer housing between the turbine housing and the rotor;

two or more shells attached to the outer housing between the stator and the outer housing and wherein the two or more shells are attached to each other by one or more springs; and one or more magnets attached to an inner surface of the two or more shells.

11. The downhole turbine of claim 10, wherein the stator includes a magnetic core.

12. The downhole turbine of claim 11, wherein one or more armature coils are disposed around the magnetic core.

13. The downhole turbine of claim 10, wherein the two or more shells are configured to expand and contract based at least partially on an electromagnetic field effecting the one or more magnets.

14. The downhole turbine of claim 13, wherein the one or more springs are configured to attach to each of the two or more shells together.

15. The downhole turbine of claim 10, wherein the one or more blades are disposed in one or more adjacent rows down a length of the outer housing.

16. The downhole turbine of claim 15, wherein the one or more blades are designed to rotate the rotor when a mud is flowing between the outer housing and the turbine housing.

17. A method comprising:

disposing a turbine into a wellbore, wherein the turbine comprises:

a stator disposed in a turbine housing;

a rotor disposed between the stator and the turbine housing and wherein the rotor includes an outer housing;

an gap that separates the stator and the rotor;

one or more blades disposed on the outer housing between the turbine housing and the rotor;

a compressible medium attached to the outer housing between the stator and the outer housing, wherein the compressible medium is separated from the stator by the gap; and one or more magnets attached to an inner surface of the compressible medium, wherein the one or more magnets are separated from the stator by the gap, and compressing the compressible medium with the one or more magnets when an electromagnetic field from the stator increases in strength from a short in one or more armature coils disposed on the stator.

18. The method of claim 17, wherein the stator includes a magnetic core.

19. The method of claim 17, further comprising reducing a current in the one or more armature coils as the one or more magnets move away from the stator.

* * * * *